US009278732B2

(12) United States Patent
Yamato et al.

(10) Patent No.: US 9,278,732 B2
(45) Date of Patent: Mar. 8, 2016

(54) VESSEL

(71) Applicant: MITSUBISHI HEAVY INDUSTRIES, LTD., Tokyo (JP)

(72) Inventors: Kuniaki Yamato, Tokyo (JP); Masanori Onzuka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/404,402

(22) PCT Filed: Jun. 26, 2013

(86) PCT No.: PCT/JP2013/067511

§ 371 (c)(1),
(2) Date: Nov. 26, 2014

(87) PCT Pub. No.: WO2014/003055

PCT Pub. Date: Jan. 3, 2014

(65) Prior Publication Data

US 2015/0122166 A1 May 7, 2015

(30) Foreign Application Priority Data

Jun. 27, 2012 (JP) ..... 2012-144769

(51) Int. Cl.

| | |
|---|---|
| ***B63B 3/56*** | (2006.01) |
| ***B63B 11/02*** | (2006.01) |
| ***B63B 11/00*** | (2006.01) |
| ***B63B 13/00*** | (2006.01) |

(Continued)

(52) U.S. Cl.

CPC ..... *B63B 11/02* (2013.01); *B63B 11/00* (2013.01); *B63B 13/00* (2013.01); *B63B 43/045* (2013.01); *B63B 43/06* (2013.01)

(58) Field of Classification Search

USPC ..... 114/78
IPC ..... B63B 11/02,11/00, 3/56, 43/045
See application file for complete search history.

(56) References Cited

U.S. PATENT DOCUMENTS 5,477,797 A * 12/1995 Stuart ..... B63B 3/20 114/125
5,582,124 A * 12/1996 Sikora ..... B63B 3/36 114/65 R

FOREIGN PATENT DOCUMENTS

JP S50-111892 U 9/1975
JP S52-143689 A 11/1977

(Continued)

OTHER PUBLICATIONS

Written Opinion mailed Oct. 1, 2013, corresponding to International application No. PCT/JP213/067511.

(Continued)

*Primary Examiner* — Stephen Avila
(74) *Attorney, Agent, or Firm* — Hauptman Ham, LLP

(57) ABSTRACT

A vessel is provided with a hull that includes left and right side walls, a bottom, and a plurality of decks including a freeboard deck; a plurality of rooms divided back and forth in a longitudinal direction of the hull by a bulkhead inside the hull; and flood control watertight compartments that are disposed inside the plurality of rooms, divide a space from a double bottom upper deck or the bottom below the freeboard deck to the freeboard deck, and are in contact with the side wall of a port side or the side wall of a starboard side and the bulkhead.

20 Claims, 11 Drawing Sheets

(51) Int. Cl.
*B63B 43/06* (2006.01)
*B63B 43/04* (2006.01)

(56) References Cited

FOREIGN PATENT DOCUMENTS

| | | | |
|---|---|---|---|
| JP | 2001-001981 | A | 1/2001 |
| JP | 2003-137168 | A | 5/2003 |
| JP | 2008-201308 | A | 9/2008 |
| JP | 2012-131242 | A | 7/2012 |

OTHER PUBLICATIONS

International Search Report issued on Oct. 1, 2013 in International Application No. PCT/JP2013/067511.
Decision to Grant a Patent mailed Dec. 1, 2015, corresponding to Japanese Patent Application No. 2014-160878.

* cited by examiner

VESSEL

RELATED APPLICATIONS

The present application is a National Phase entry of International Application No. PCT/JP2013/067511, filed Jun. 26, 2013, which claims priority of Japanese Application No. 2012-144769, filed Jun. 27, 2012.

FIELD

The present invention relates to a vessel such as a passenger vessel, a ferry, a RO-RO ship (Roll-on/Roll-off Ship), a PCC (Pure Car carrier) and a PCTC (Pure Car/Truck Carrier) as an automobile carrier.

BACKGROUND

For example, in a conventional passenger vessel, in general, a compartment having multilayered decks is provided in a hull, and a ramp way configured to connect between the decks each layer is provided in each compartment. In this case, residence compartments are formed in an upper layer of the hull, and vehicle compartments are formed in a lower layer, and a driver drives a car to enter the deck in the vessel from a quay wall via a shore ramp way, and moves the car to the deck of the lower layer via the ramp way to park at a specified position.

In addition, in such a passenger vessel, apart from the residence compartments and the vehicle compartments, a plurality of rooms such as an engine room and a shaft room are divided in the vessel. In this case, as international rules for vessels, the requirements of damage stability are defined and are also reflected in the Japanese domestic law. In the rules, as requirements of the vessel side damage, securement of residual restoring force after damage, and a hull inclination angle and the like are defined.

In addition, there is a compartment structure of the conventional vessel as described in Patent Literature 1 below. In an automobile carrier described in Patent Literature 1, a watertight deck of a lowest layer forming a void space in a bottom of the vessel is provided with a remotely openable seawater introducing means. Thus, when a vessel side outer plate of the vessel or the like is damaged and seawater enters the vessel, by opening the seawater introducing means provided in the watertight deck of the lowest layer, the seawater entered the vessel is introduced into the void space, the void space is allowed to function as a seawater ballast tank, and thus, it is possible to recover the restoring force of the vessel.

CITATION LIST

Patent Literature

Patent Literature 1: Japanese Laid-open Patent Publication No. 2008-201308Summary

Technical Problem

In the international rules of the above-described conventional vessel, as the vessel side damage, damage assumption length, width, and height at the time of damage are determined by the number of passengers, a length, a width, and a draft of the vessel, and the vessel side damage becomes a damage requirement of two compartments across the bulkhead, when a compartment (for example, an engine room, an auxiliary machinery room, a shaft room or the like) in which an flooding volume becomes large at the time of damage is damaged. For that reason, the flooding volume at the time of damage of the vessel becomes excessive, and GoM (transverse metacentric height) as an item of restoration performance of regulatory requirements becomes larger. In this case, since there are restrictions on a vessel form design, restrictions on a superstructure, and restrictions on compartment arrangement, a degree of freedom of arrangement is limited.

The present invention has been made to solve the above-described problems, and an object thereof is to provide a vessel that is capable of suppressing entry of water into the plurality of rooms in case of damage.

Solution to Problem

According to an aspect of the present invention, a vessel includes: a hull that includes side walls of a port side and a starboard side, a bottom, and a plurality of decks including a freeboard deck; a bulkhead that is provided inside the hull to divide interior of the hull into a plurality of rooms in a longitudinal direction of the hull; and a flood control watertight compartment that is disposed inside at least one of the plurality of rooms, divides a space from a deck below the freeboard deck or the bottom to the freeboard deck, and is in contact with the side walls and the bulkhead.

With this structure, even if the vicinity of the bulkhead on the side wall is damaged, since flooding is stopped at the flood control watertight compartment, the possibility of flooding across the plurality of rooms is reduced, and it is possible to suppress flooding to the plurality of rooms in case of damage. Furthermore, the vessel may suppress the size reduction of the plurality of rooms that is performed to reduce the flooding volume during flooding, thereby relieving the compartment restriction on the layout design to expand the degree of freedom of design.

Advantageously, in the vessel, the flood control watertight compartment has a left flood control watertight compartment that is in contact with the side wall of the port side and the bulkhead, and a right flood control watertight compartment that is in contact with the side wall of the starboard side and the bulkhead.

With this structure, since the flood control watertight compartments are each provided on both right and left sides of the hull, it is possible to improve the flood control performance. Further, by inducing the water flooded to the flood control watertight compartment that is not damaged, it is possible to suppress the influence of flooding.

Advantageously, in the vessel, the flood control watertight compartment is each provided between the bulkhead and the side wall of the port side, and between the bulkhead and the side wall of the starboard side.

With this structure, by sharing the flood control watertight compartments by the front and back rooms in the longitudinal direction of the hull divided by the bulkhead, it is possible to achieve the simplification and the cost reduction of the structure.

Advantageously, in the vessel, the flood control watertight compartment is each provided on each room side that is disposed back and forth in the longitudinal direction of the hull with the bulkhead interposed therebetween.

With this structure, by providing the flood control watertight compartments front and back of the bulkhead in the longitudinal direction of the hull, it is possible to further improve the flood control performance.

Advantageously, in the vessel, the flood control watertight compartment has a smaller volume compared to the plurality of rooms, and a dimension in a lateral direction of the hull, which extends to the inside of the hull from the side wall of the port side or the side wall of the starboard side, is greater than one-tenth of a width of the hull at a load water line.

With this structure, the dimension of the flood control watertight compartment can be set to be greater than the magnitude of the assumed damage, and it is possible to sufficiently secure the flood control performance by the flood control watertight compartment.

Advantageously, in the vessel, the hull is provided with a longitudinal bulkhead along the side walls of the port side and the starboard side, on the inner side of each of the side walls of the port side and the starboard side on a bow side, and the flood control watertight compartment is provided on each the side walls of the port side and the starboard side that have no longitudinal bulkhead on the inner side of the hull.

With this structure, a space of a stern side with no longitudinal bulkhead is secured. Furthermore, even on the stern side with no longitudinal bulkhead, the vessel is able to sufficiently secure the flood control performance by the flood control watertight compartment.

Advantageously, in the vessel, the flood control watertight compartment is raised to be higher than the freeboard deck.

When the flood control watertight compartment is flooded and the height of the flooded water reaches the height of a freeboard deck, there is a possibility that the top of the freeboard deck is flooded, and flooding expands to other compartments to reduce stability of the hull. With the above-described structure, since the upper surface of the flood control watertight compartment is raised to be higher than the freeboard deck, the flooded water is prevented from reaching the freeboard deck by the side wall of the inboard side of the flood control watertight compartment, and it is possible to suppress the possibility of a decrease in stability of the hull.

Advantageously, in the vessel, a duct is disposed above the flood control watertight compartment.

With this structure, even if the flood control watertight compartment is provided, it is possible to secure a mounting amount of the freeboard deck.

Advantageously, in the vessel, the flood control watertight compartment has a smaller volume compared to the plurality of rooms, and a dimension of the flood control watertight compartment in the longitudinal direction of the hull is set to be greater than a larger length obtained by comparing 3/100 of the longer length with 3 m when comparing a total length of the deck that limits a flooding range in a height direction, or a length between a front end and a rear end of a projected length of the hull below a load water line.

With this structure, the dimension of the flood control watertight compartment may be set to be greater than the magnitude of the assumed damage, it is possible to sufficiently secure the flood control performance by the flood control watertight compartment. In addition, the deck configured to limit the flooding range in the height direction means any lower deck between the lowest deck (the deck of the top layer when there is no deck that exceeds the height) and the deck as the upper limit of the range that can enter the reserve buoyancy, in the decks that exceed the height obtained by adding 12.5 m to the draft of the load water line.

Advantageously, in the vessel, a valve is provided in a pipe that injects liquid to the flood control watertight compartment, and the valve is disposed outside the flood control watertight compartment.

With this structure, the valve is less likely to be damaged. Therefore, the vessel is able to reduce the possibility that flooding expands to other compartments through the damaged pipe, by closing the valve.

Advantageous Effects of Invention

According to the vessel of the present invention, it is possible to suppress flooding into the plurality of rooms in case of damage.

BRIEF DESCRIPTION OF DRAWINGS

FIG. 13-1 is a partial plan view illustrating a flood control watertight compartment according to a third embodiment.

FIG. 13-2 is a partial plan view illustrating a modified example of the flood control watertight compartment according to the third embodiment.

DESCRIPTION OF EMBODIMENTS

Aspects (embodiments) for carrying out the present invention will now be described in detail with reference to the drawings. The present invention is not limited by the contents to be described in the following embodiments. In addition, the components to be described below include those capable of being easily assumed by those skilled in the art, and those that are substantially the same. Furthermore, the components to be described below can be combined as appropriate.

First Embodiment

Figure 1:
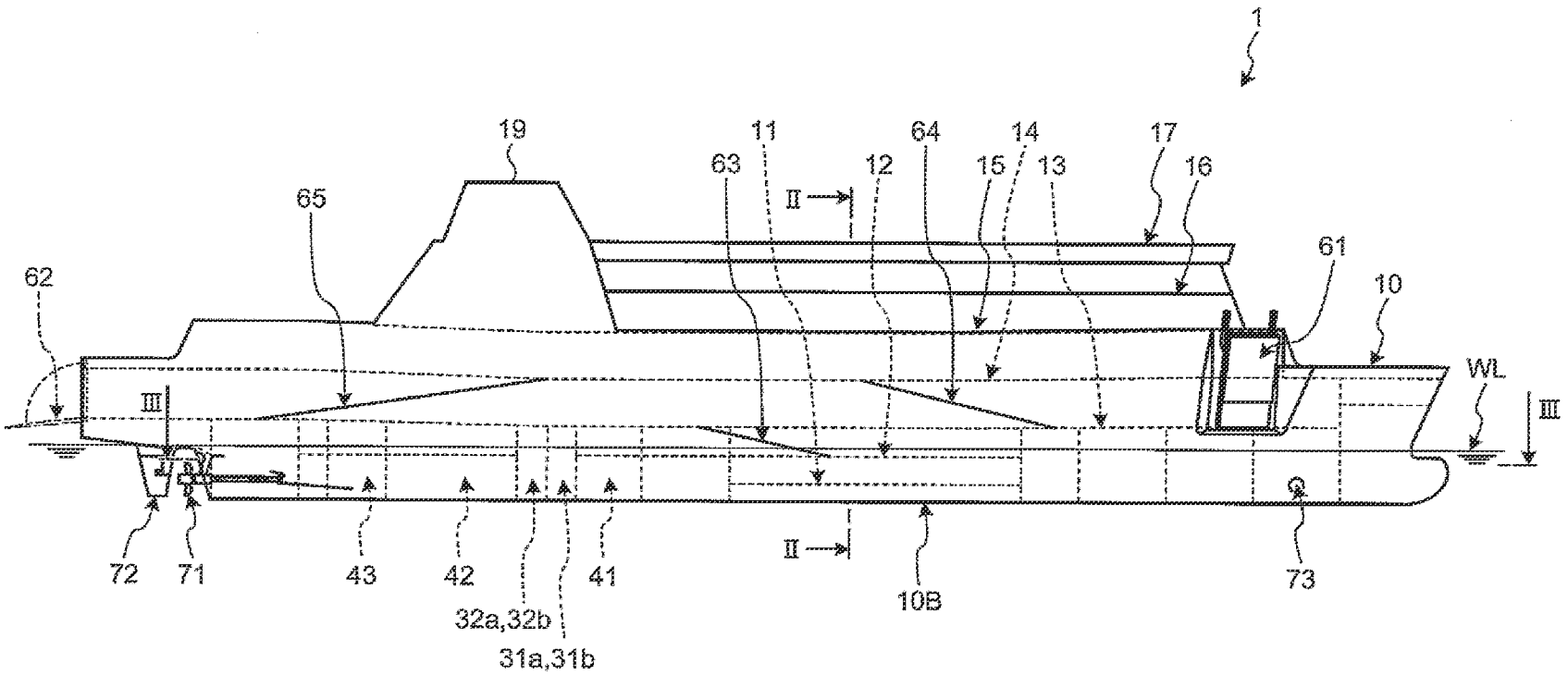
FIG. 1 is a schematic diagram illustrating a side surface of a vessel according to a first embodiment.
Figure 2:
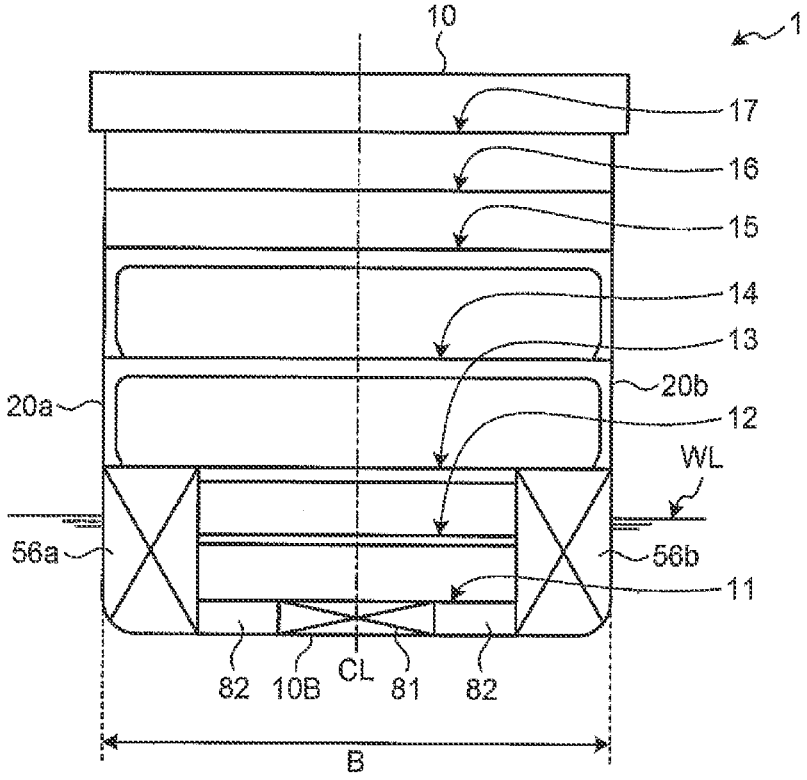
FIG. 2 is a schematic diagram of a cross-section taken along a line II-II of the vessel illustrated in FIG. 1.
Figure 3:
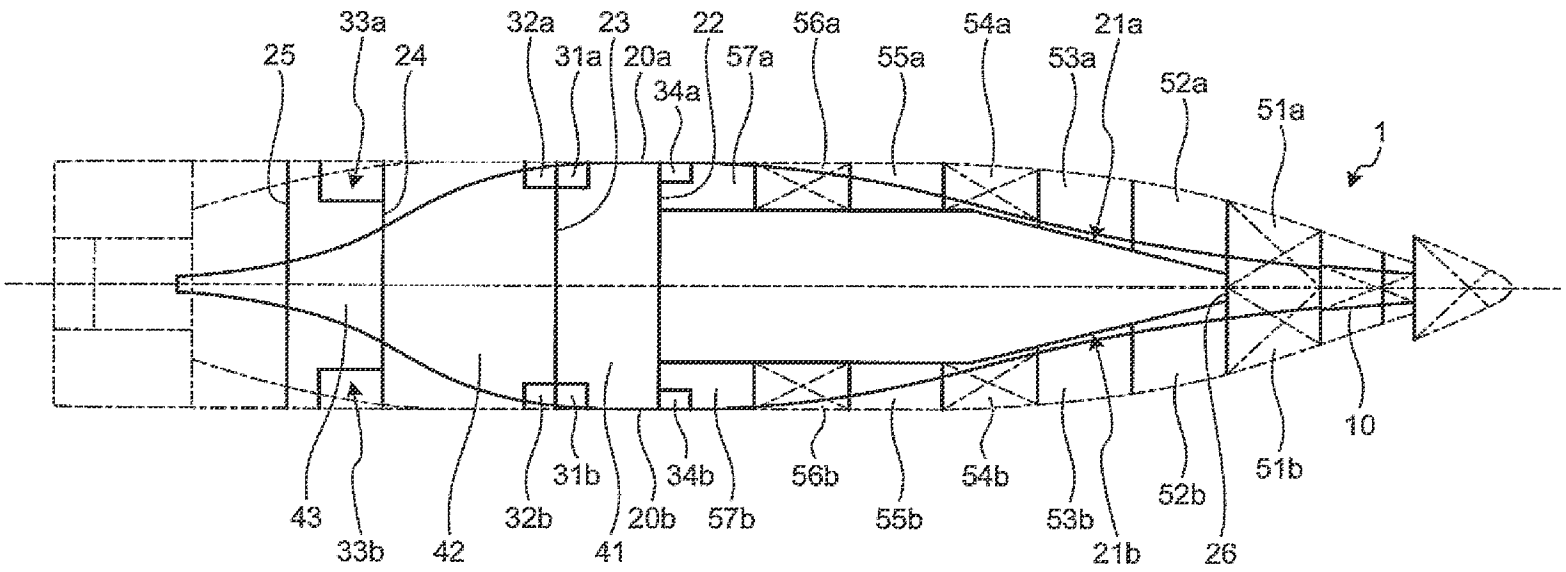
FIG. 3 is a schematic diagram of a cross-section taken along a line of the vessel illustrated in FIG. 1.

FIG. 1 is a schematic diagram illustrating a side surface of a vessel according to a first embodiment. FIG. 2 is a schematic diagram of a cross-section taken along a line II-II of the vessel illustrated in FIG. 1. FIG. 3 is a schematic diagram of a cross-section taken along a line of the vessel illustrated in FIG. 1. In FIG. 3, a solid line illustrates a structure of a hull 10 when the line of FIG. 1 is seen from above, and a dashed line illustrates a structure of the hull 10 when the line of FIG. 1 is seen from below.

A vessel 1 illustrated in FIG. 1 is a vehicle carrier to car ferry) that is capable of carrying the vehicle. As illustrated in FIG. 2, the hull 10 of the vessel 1 is surrounded by a bottom 10B, and left and right side walls (outer plates) 20*a* and 20*b*. WL is a load water line of the hull 10. B is a width of the hull 10 on the load water line WL. CL is a center of the width in a lateral direction of the hull. The hull 10 includes a propeller 71 that is connected to a main engine as a main propulsive force source to transmit the driving force, and a rudder 72 that controls the direction of the hull 10. The vessel 1 is able to apply the propulsive force in any direction of the hull 10 by the rotation of the propeller 71 and a steering direction of the rudder 72. In order to control the direction of the hull 10 at an early stage, the hull 10 is provided with a bow thruster 73. In addition, the hull 10 is provided with a funnel 19 serving as a chimney.

In a bow side starboard of the hull 10, a retractable bow broadside ramp way 61 for allowing roll-on or roll-off of the vehicle is provided, and in a stern side starboard, a retractable stern ramp way 62 of the stern side is provided. Moreover, a freeboard deck 13 is a boarding deck that is provided with the stern ramp way 62 of the stern side or the bow broadside ramp way 61. A lower space is formed below the freeboard deck 13, and a main engine room (engine room) 42, in which a propulsion engine is disposed, is provided on the stern side of the lower space. In the hull 10, multilayered-decks 12, 14, 15, 16, and 17 are provided above and below the freeboard deck 13. A deck 11 is a double bottom upper deck as a double bottom between the freeboard deck 13 and the bottom 10B. Hereinafter, the deck 11 will be referred to as the double bottom upper deck 11.

Furthermore, between the freeboard deck 13 and the deck 14, at least one inboard ramp 64 or 65 is provided through which a large vehicle also passes. At least one inboard ramp may be provided between the deck 14 and the deck 15. Moreover, as illustrated in FIG. 2, a vehicle-mounting compartment capable of mounting a large vehicle such as a truck and a bus is formed on the freeboard deck 13 and the deck 14.

Between the deck 12 and the freeboard deck 13, at least one inboard ramp 63 is provided through which the vehicle can pass. The vehicle-mounting compartment is also formed on the deck 12 below the freeboard deck 13, and longitudinal bulkheads 21*a* and 21*b* are provided on the bow side of the hull 10 so as to surround the vehicle-mounting compartment on the deck 12.

Between the side wall 20*a* of the port side and the longitudinal bulkhead 21*a*, and between the side wall 20*b* of the starboard side and the longitudinal bulkhead 21*b*, multiple watertight compartments 51*a*, 52*a*, 53*a*, 54*a*, 55*a*, 56*a*, 57*a*, 51*b*, 52*b*, 53*b*, 54*b*, 55*b*, 56*b*, and 57*b* are formed. The multiple watertight compartments 51*a*, 52*a*, 53*a*, 54*a*, 55*a*, 56*a*, 57*a*, 51*b*, 52*b*, 53*b*, 54*b*, 55*b*, 56*b*, and 57*b* can be used as a void space, a fuel tank, a ballast tank, an engine room, a warehouse or a cargo.

As a residence area, decks 15, 16 and 17 are provided, and a plurality of residence compartments are formed. In this case, in order to avoid noise from the propulsion engine, the residence compartments are formed on the bow side directly above the room 42 (main engine room) as an installation position of the propulsion engine. Moreover, the stern side of the residence compartment (above the deck 15) is used as a promenade space.

Furthermore, the hull 10 has left and right side walls 20*a* and 20*b*, and a bottom 10B, and a plurality of rooms 41, 42, and 43 are provided in the space between the freeboard deck 13 and the bottom 10B, and in a space behind the disposition position of the deck 12. The room 41 is generator room. The room 42 is the main engine room. The room 43 is a shaft room. The space surrounded by the double bottom upper deck 11, the bottom 10B, and the left and right side walls 20*a* and 20*b* is available as a void space, a fuel tank, a ballast tank or an empty space. For example, as illustrated in FIG. 2, a void space 31 between the bottom 10B and the double bottom upper deck 11 is provided inside the hull 10, and ballast tanks 82 are each provided on the left and right side walls 20*a* and 20*b* of the void space 81. In addition, on the bow side of the bulkhead 22 of the hull 10, a bow bulkhead 26 is further provided. Moreover, the above-described void space 81 is disposed between the bow bulkhead 26 and the bulkhead 22. The void space 81 may be disposed between the bow bulkhead 26 and the bulkhead 22 and may be divided in the longitudinal direction of the hull 10. Also, the void space 31 may be disposed between the bow bulkhead 26 and the bulkhead 22 and may be symmetrically or asymmetrically divided in the lateral direction (widthwise direction) of the hull 10. The double bottom upper deck 11 may be disposed from the bow to the stern. In this embodiment, there is an empty space between the double bottom upper deck 11 and the deck 12, an inboard ramp may be provided between the double bottom upper deck 11 and the deck 12, and the double bottom upper deck 11 may be used as a vehicle deck of the lowest layer. In this case, a lower vehicle-mounting compartment DL illustrated in FIG. 3 is a space that is surrounded by the double bottom upper deck 11, the freeboard deck 13 (or the deck 12), the longitudinal bulkheads 21*a* and 21*b*, the bow bulkhead 26, and the bulkhead 22.

As illustrated in FIG. 1, since the deck 12 is provided between the freeboard deck 13 and the bottom 10B, the upper and lower spaces (rooms) of the hull 10 are divided. Further, since the hull 10 is provided with the bulkheads 25, 24, 23, and 22 that divide the part between the starboard side wall 20*a* of the port side and the side wall 20*b* of the starboard at intervals towards the bow from the stern, the rooms 43, 42, and 41 are divided in the longitudinal direction of the hull 10.

Moreover, the hull 10 is provided with left flood control watertight compartments 31*a* and 32*a* that are in contact with the side wall 20*a* of the port side and the bulkhead 23, and right flood control watertight compartments 31*b* and 32*b* that are in contact with the side wall 20*b* of the starboard side and the bulkhead 23. In addition, the hull 10 is provided with a left flood control watertight compartment 33*a* that is in contact with the side wall 20*a* of the port side and the bulkhead 24, and a right flood control watertight compartment 33*b* that is in contact with the side wall 20*b* of the starboard side and the bulkhead 24. In addition, the hull 10 is provided with a left flood control watertight compartment 34*a* that is in contact with the side wall 20*a* of the port side and the bulkhead 24, and a right flood control watertight compartment 34*b* that is in contact with the side wall 20*b* of the starboard side and the bulkhead 24. The flood control watertight compartments 31*a*, 32*a*, 33*a*, and 34*a* and the flood control watertight compartments 31*b*, 32*b*, 33*b*, and 34*b* are symmetrically disposed in the port and the starboard (linear-symmetrical arrangement in the widthwise direction of the hull 10 to the center CL illustrated in FIG. 2 as an axis of symmetry), and the magnitudes of the volume of the flood control watertight compartments corresponding to each of the port and the starboard are equal to each other. Hereinafter, the flood control watertight compartments 31*a*, 31*b*, 32*a*, and 32*b* will be described. Since the flood control watertight compartments 33*a*, 33*b*, 34*a*, and 34*b* have the same configuration as that of the flood control watertight compartments 31*a*, 31*b*, 32*a*, and 32*b*, the description thereof will not be provided.

Figure 4:
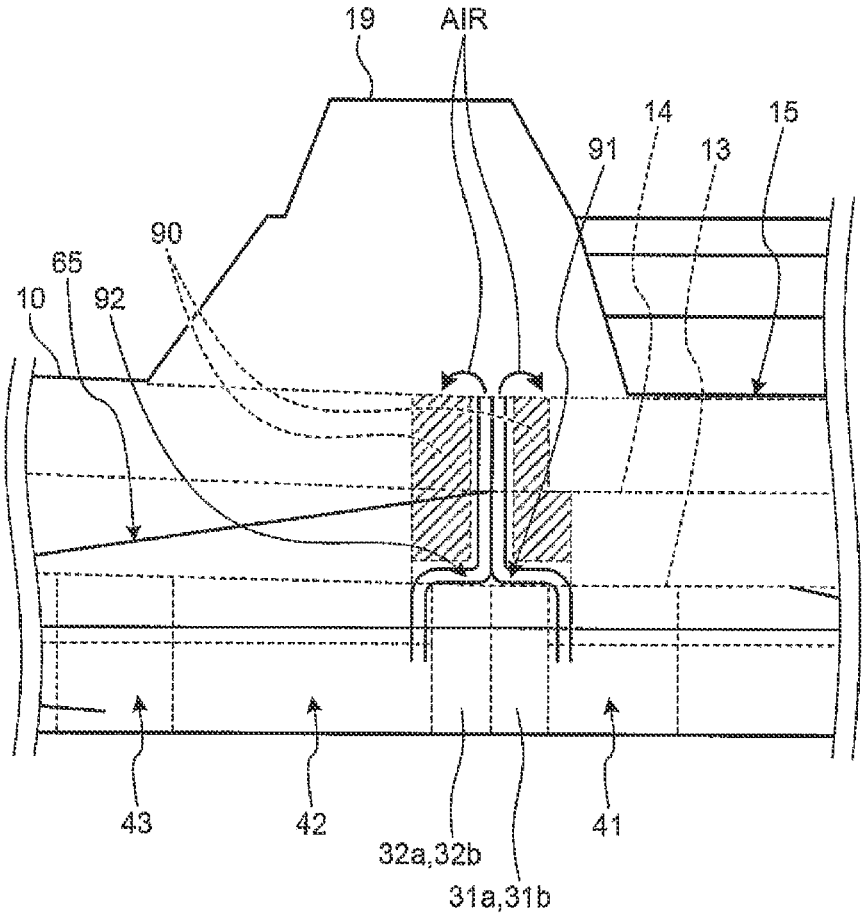
FIG. 4 is an explanatory view illustrating a relation between a flood control watertight compartment and a duct according to the first embodiment.

FIG. 4 is a diagram illustrating a relation between the flood control watertight compartment and the duct according to the first embodiment. As illustrated in FIG. 4, in this case, each of the flood control watertight compartments 31*a*, 31*b*, 32*a*, and 32*b* is disposed at a position that overlaps in the height direction with a duct 90 formed by bundling pipes 91 and 92 extending to the upside of the freeboard deck 13 from the room 42 (main engine room) and the room 41 (generator room). The duct 90 is a ventilation duct that exhausts a flue gas AIR of the room 42 (main engine room) and the room 41 (generator room) to the funnel 19.

Figure 5:
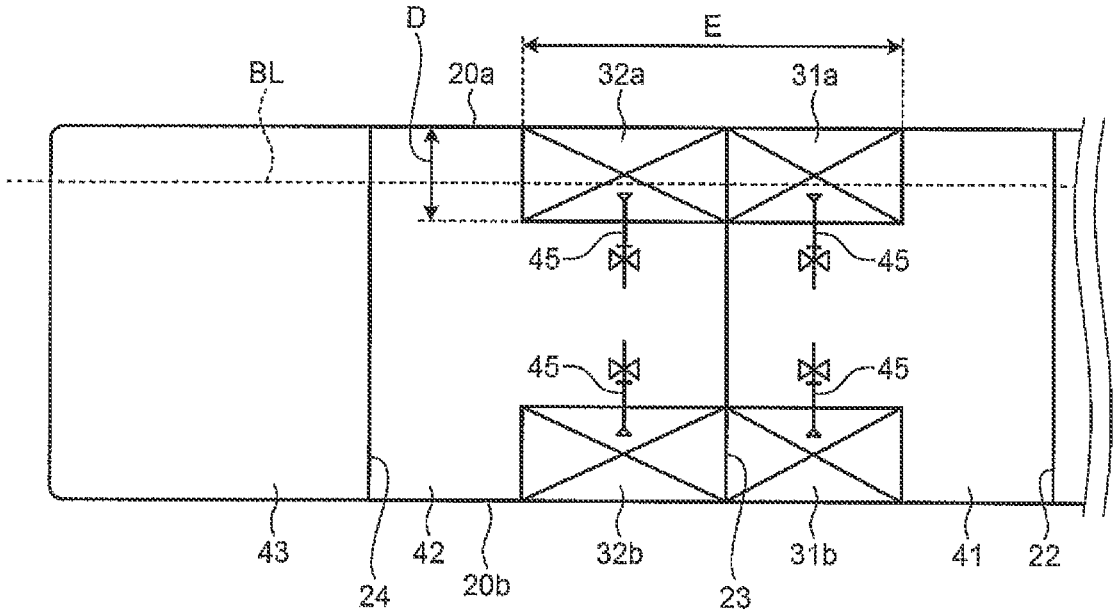
FIG. 5 is a partial plan view illustrating the flood control watertight compartment according to the first embodiment.
Figure 6:
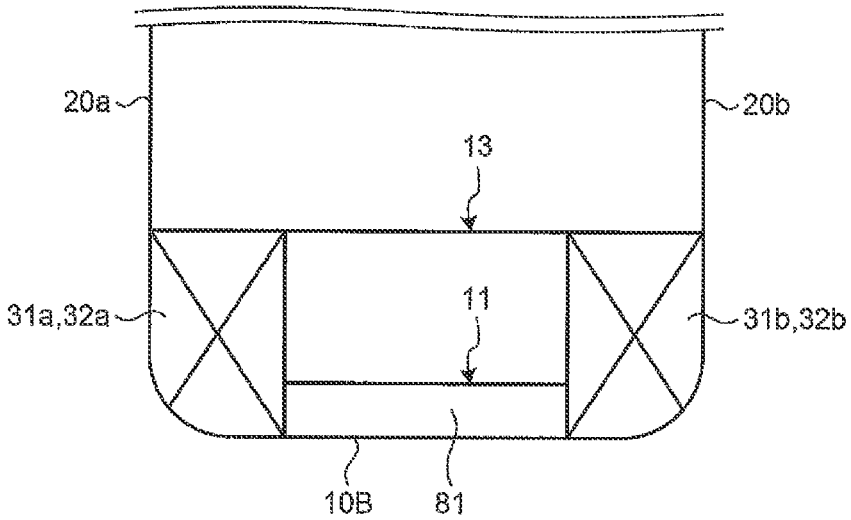
FIG. 6 is a cross-sectional view of the flood control watertight compartment illustrated in FIG. 5.

FIG. 5 is a partial plan view illustrating the flood control watertight compartment according to the first embodiment. FIG. 6 is a cross-sectional view of the flood control watertight compartment illustrated in FIG. 5. As illustrated in FIGS. 5 and 6, the flood control watertight compartments 31*a* and 32*a* (31*b* and 32*b*) have a smaller volume compared to each of the generator room 41 and the room 42 (main engine room) as the plurality of rooms. In addition, as illustrated in FIG. 6, the flood control watertight compartments 31*a* and 32*a* (31*b* and 32*b*) are the watertight compartments that are divided from the bottom 10B of the hull 10 to the freeboard deck 13. Moreover, the flood control watertight compartments 31*a* and 32*a* (31*b* and 32*b*) are one compartment which communicates from the bottom 10B of the hull 10 to the freeboard deck 13. Moreover, in the flood control watertight compartments 31*a* and 32*a* (31*b* and 32*b*), a dimension D in a direction (lateral direction) perpendicular to the longitudinal direction of the hull 10 toward the inside of the hull 10 from the left side wall 20*a* (the right side wall 20*b*) is greater than a virtual line BL in which one-tenth of the width B of the hull 10 on the load water line WL is drawn along the inside of the left side wall 20*a* (the right, side wall 20*b*). That is, the dimension D is greater than one-tenth of the width B of the hull 10. In addition, a length (dimension) B obtained by combining each length of the flood control watertight compartments 31*a* and 32*a* (31*b* and 32*b*) in the longitudinal direction of the hull 10 toward the bow direction from the stern is set to be greater than the larger length obtained by comparing 3/100 of the larger length with 3 m, when comparing the total length of the deck that limits the flooding range in the height direction, or the length between a front end and a rear end of a projected length of the hull 10 below the load water line WL. In this embodiment, the deck that limits the flooding range in the height direction means, in the decks which exceed the height obtained by adding 12.5 m to the draft of the load water line WL, any lower one between the lowest deck (the deck of the top layer when there is no deck that exceeds the height) and the deck as the upper limit of the range that can enter the reserve buoyancy. As a result, the dimension of the flood control watertight compartments 31*a* and 32*a* (31*b* and 32*b*) can be set to be greater than the magnitude of the assumed damage defined in each of SOLAS Chapter II-1 Part. B-1 Regulation 8.3.2 as an international law, and Article 44 of vessel compartment regulations as Japanese domestic law. As a result, it is possible to secure the sufficient flood control performance by the flood control watertight compartments 31*a* and 32*a* (31*b* and 32*b*).

Similarly, the flood control watertight compartments 33*a* and 33*b* illustrated in FIG. 3 have a smaller volume compared to the room 43 (shaft chamber). Moreover, the dimension in the direction (lateral direction) perpendicular to the longitudinal direction of the hull 10 extending to the inside of the hull 10 from the left and right side walls 20*a* and 20*b* of the flood control watertight compartments 33*a* and 33*b* in the lateral direction is greater than the above-described virtual line BL. In addition, the length (dimension) of the flood control watertight compartment 33*a* (33*b*) in the longitudinal direction of the hull 10 is set to be greater than the larger length obtained by comparing 3/100 of the larger length with 3 m, when comparing the total length of the deck that limits the flooding range in the height direction, or the length between the front end and the rear end of the projected length of the hull 10 below the load water line WL. In this embodiment, the deck that limits the flooding range in the height direction means, in the decks which exceed the height obtained by adding 12.5 m to the draft of the load water line WL, any lower one between the lowest deck (the deck of the top layer when there is no deck that exceeds the height) and the deck as the upper limit of the range that can enter the reserve buoyancy. Thus, the dimension of the flood control watertight compartments 33*a* and 33*b* can also be set to be greater than the magnitude of the assumed damage that is defined in each of SOLAS Chapter II-1 Part. B-1 Regulation 8.3.2 as an international law, and Article 44 of vessel compartment regulations as a Japanese domestic law. As a result, it is possible to secure the sufficient flood control performance by the flood control watertight compartment 33*a* (33*b*).

When the side wall 20*a* of the port side located in the vicinity of the bulkhead 23 is damaged from the outside of the hull 10, the flood control watertight compartments 31*a* and 32*a* are flooded, but it is possible to suppress flooding to the room 42 (main engine room) and the room 41 (generator room). In addition, since the flood control watertight compartments 31*a* and 32*a* smaller than the room 42 (main engine room) and the room 41 (generator room) are flooded, it is possible to suppress flooding to the room 42 (main engine room) and the room 41 (generator room). In addition, when the flood control watertight compartments 31*a* and 32*a* (31*b* and 32*b*) are used as a liquid tank, such as a freshwater tank, a ballast tank, and a fuel tank, the valve 45 of each liquid tank is provided outside the flood control watertight compartments 31*a* and 32*a* (31*b* and 32*b*). The valve 45 is provided in the pipe that injects liquid to the flood control watertight compartments 31*a* and 32*a* (31*b* and 32*b*). Moreover, for example, even if the vicinity of the bulkhead 23 in the side wall 20*a* of the port side is damaged and the flood control watertight compartments 31*a* and 32*a* are damaged and flooded, the valve 45 is less likely to be damaged. Consequently, by closing the valve 45, it is possible to reduce the possibility that flooding expands to another compartment through the damaged pipe. In addition, the valve 45 may be a valve that is able to remotely control opening and closing by a control unit 2 to be described below.

As described above, the vessel 1 is equipped with the hull 10 that has the left and right side walls 20*a* and 20*b*, the bottom 10B, and the plurality of decks including the freeboard deck 13; the plurality of rooms 41 and 42 divided back and forth in the longitudinal direction of the hull 10 by the bulkhead 23 inside the hull 10; and the flood control watertight compartments 31*a*, 31*b*, 32*a*, and 32*b* that are disposed inside the plurality of rooms 41 and 42, divide a space from the bottom 10B to the freeboard deck 13, and are in contact with the side wall 20*a* or the side wall 20*b* and the bulkhead 23. Moreover, the flood control watertight compartments 32*a* and 32*b* are disposed inside the room 42. The flood control watertight compartments 31*a* and 31*b* are disposed inside the room 41.

As a result, even if the vicinity of the bulkhead 23 in the side walls 20*a* and 20*b* is damaged, since the flood control watertight compartments 31*a*, 31*b*, 32*a*, and 32*b* are flooded, it is possible to suppress flooding to the room (main engine room) 42 and the room 41 (generator room) as the front and back rooms in the longitudinal direction of the hull 10. Moreover, the vessel 1 is able to suppress the size reduction of the plurality of rooms 41 and 42 that is performed to reduce the flooding volume when being flooded, thereby relieving the compartment constraints on the layout design and expanding the degree of freedom in design.

In addition, in the vessel 1 of the first embodiment, as the flood control watertight compartment, the left flood control watertight compartments 31*a* and 32*a* coming into contact with the side wall 20*a* of the port side and the bulkhead 23, and the right, flood control watertight compartments 31*b* and 32*b* coming into contact with the side wall 20*b* of the starboard side and the bulkhead 23 are provided. Thus, since the flood control watertight compartments 31*a*, 31*b*, 32*a*, and 32*b* are each provided on both left and right sides of the hull 10, it is possible to improve the flood control performance.

In addition, in the vessel 1 of the first embodiment, the flood control watertight compartment. 31*a*, 31*b*, 32*a*, and 32*b* have a smaller volume compared to the room 42 (main engine room) and the room 41 (generator room) as the plurality of rooms. Furthermore, the dimension D in a direction intersecting the longitudinal direction of the hull 10 is greater than the virtual line BL that is one-tenth of the width 13 of the hull 10 on the load water line WL. As a result, it is possible to secure the sufficient flood control performance by the flood control watertight compartment.

First Modified Example of First Embodiment

Figure 7:
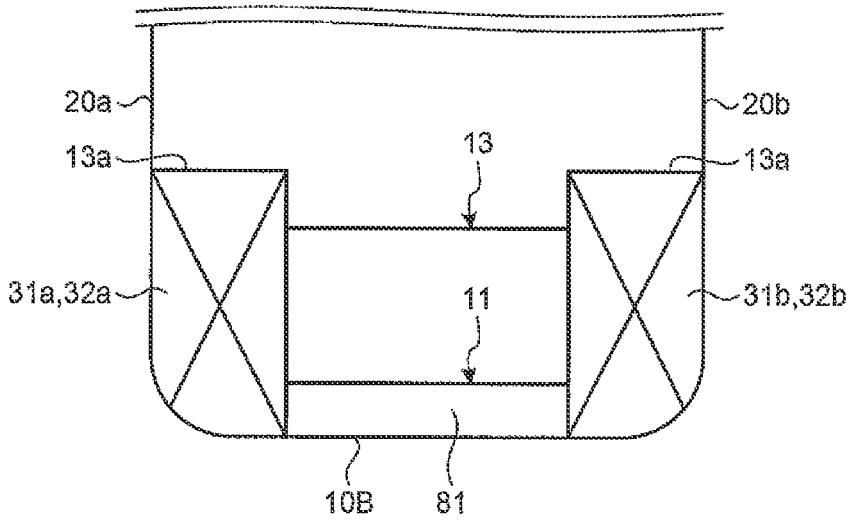
FIG. 7 is a cross-sectional view illustrating a first modified example of the flood control watertight compartment illustrated in FIG. 5.

FIG. 7 is a cross-sectional view illustrating a first modified example of the flood control watertight compartment illustrated in FIG. 5. The same components as those in the above-described first embodiment are denoted by the same reference numerals, and a repetitive description thereof will not be provided. As illustrated in FIG. 7, an upper surface 13*a* of the flood control watertight compartments 31*a* and 32*a* (31*b* and 32*b*) is raised to be higher than the freeboard deck 13. In addition, as illustrated in FIG. 7, the flood control watertight compartments 31*a* and 32*a* (31*b* and 32*b*) are the watertight compartments divided from the bottom 10B of the hull 10 to the upper surface 13*a* of the flood control watertight compartments 31*a* and 32*a* (31*b* and 32*b*). Moreover, the flood control watertight compartments 31*a* and 32*a* (31*b* and 32*b*) are one compartment which communicates from the bottom 10B of the hull 10 to the upper surface 13*a* of the flood control watertight compartments 31*a* and 32*a* (31*b* and 32*b*).

When the side wall 20*a* of the port side located in the vicinity of the bulkhead 23 is damaged from the outside of the hull 10, the flood control watertight compartments 31*a* and 32*a* are flooded, and when the height of the flooded water reaches the height of the freeboard deck 13, the stability of the hull 10 is likely to decrease. Since the upper surface 13*a* of the flood control watertight compartments 31*a* and 32*a* (31*b* and 32*b*) according to the first modified example is raised to be higher than the freeboard deck 13, it is possible to suppress the expansion of flooding to the upper part of the freeboard deck 13 from the flood control watertight compartments 31*a* and 32*a* (31*b* and 32*b*) and to increase the stability of the hull 10.

As described above, if each of the flood control watertight compartments 31*a*, 31*b*, 32*a*, and 32*b* is disposed so as to be disposed at a position that overlaps the duct 90, in which the pipes 91 and 92 extending to the upper part of the freeboard deck 13 from the room 42 (the main engine room) and the room 41 (generator room) are bundled, in the height direction, even if the upper surface 13*a* of the flood control watertight compartments 31*a* and 32*a* (31*b* and 32*b*) is raised to be higher than the freeboard deck 13, it is possible to suppress the influence on the mounting amount of cargo to be mounted to the freeboard deck 13.

Second Modified Example of First Embodiment

Figure 8:
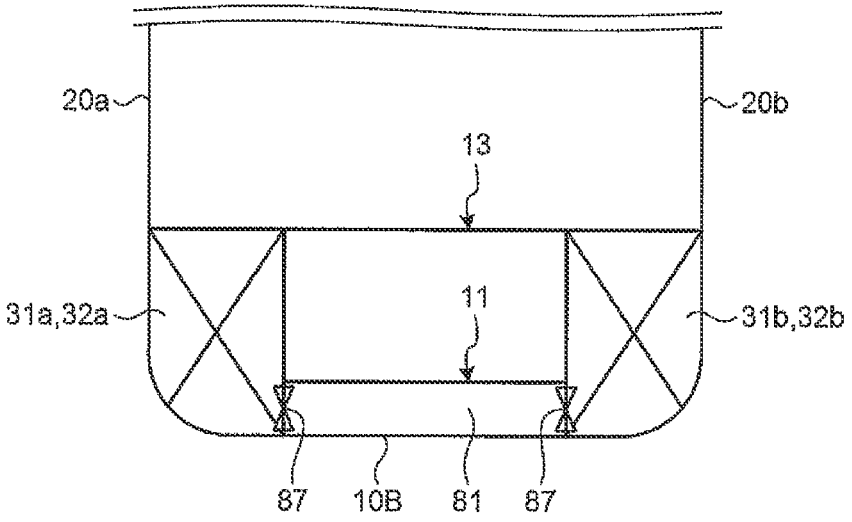
FIG. 8 is a cross-sectional view illustrating a second modified example of the flood control watertight compartment illustrated in FIG. 5.

FIG. 8 is a cross-sectional view illustrating a second modified example of the flood control watertight compartment illustrated in FIG. 5. The same components as those in the above-described first embodiment are denoted by the same reference numerals, and a repetitive description thereof will not be provided. As illustrated in FIG. 8, the flood control watertight compartments 31*a* and 32*a* (31*b* and 32*b*) are divided from the adjacent void space 81, and have a watertight sliding door 87 on the inner wall located inside the hull 10.

When the side wall 20*a* of the port side located in the vicinity of the bulkhead 23 is damaged from the outside of the hull 10, the flood control watertight compartments 31*a* and 32*a* are flooded, but it is possible to suppress flooding to the room 42 (main engine room) and the room 41 (generator room). Furthermore, by opening the watertight sliding door 87, it is possible to allow the water flooded to the flood control watertight compartments 31*a* and 32*a* (31*b* and 32*b*) to enter the adjacent void space, thereby lowering the center of gravity of the hull 10. In addition, by opening the watertight sliding door 87, for example, the water flooded to the flood control watertight compartments 31*a* and 32*a* is flooded to the undamaged flood control watertight compartments 31*b* and 32*b* of the opposite side of the vessel, and the vessel 1 is able to suppress the inclination of the hull 10 due to the influence of flooding.

Third Modified Example of First Embodiment

Figure 9:
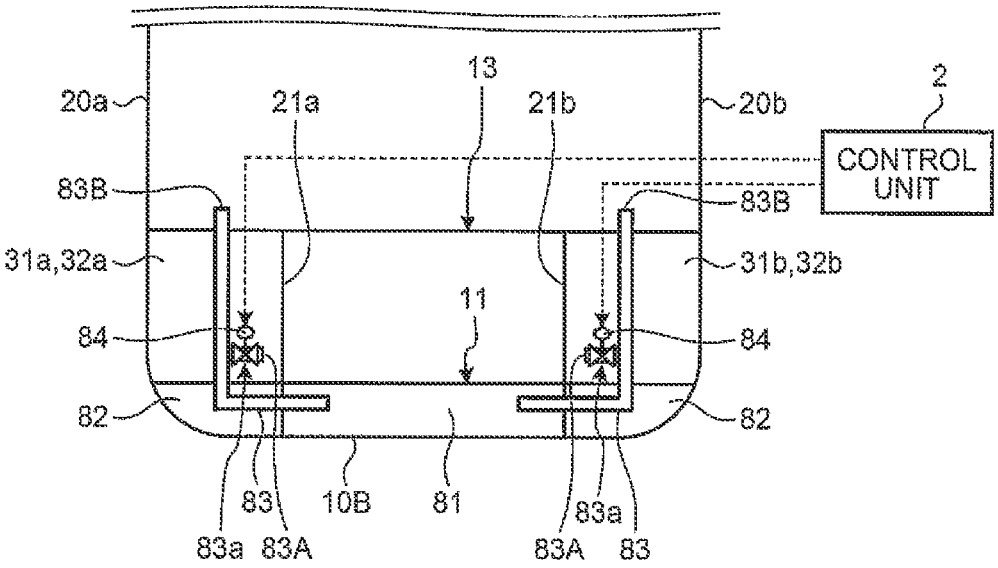
FIG. 9 is a cross-sectional view illustrating a third modified example of the flood control watertight compartment illustrated in FIG. 5.

FIG. 9 is a cross-sectional view illustrating a third modified example of the flood control watertight compartment illustrated in FIG. 5. The same components as those in the above-described first embodiment are denoted by the same reference numerals, and a repetitive description thereof will not be provided. As illustrated in FIG. 9, the flood control watertight compartments 31*a* and 32*a* (31*b* and 32*b*) are the watertight compartments that are divided from the double bottom upper deck 11 below the freeboard deck 13 to the freeboard deck 13. Moreover, the flood control watertight compartments 31*a* and 32*a* (31*b* and 32*b*) are one compartment which communicates from the double bottom upper deck 11 to the freeboard deck 13. In addition, as illustrated in FIG. 9, in the flood control watertight compartments 31*a* and 32*a* (31*b* and 32*b*), a seawater guide pipe 83 is provided in the bulkhead that is divided from the adjacent void space. The seawater guide pipe 83 connects the space below the freeboard deck 13 and above the double bottom upper deck 11 to the void space 81, through the ballast tank 82 and the double bottom upper deck 11 from the void space 81. The seawater guide pipe 83 is a tube member that connects the space surrounded by the bottom 10B, the double bottom upper deck 11, and the side walls 20*a* and 20*b* of the port and the starboard to the space below the freeboard deck 13 and above the double bottom upper deck 11. The seawater guide pipe 83 is provided with at least a seawater inlet port 83A in the space below the freeboard deck 13 and above the double bottom upper deck 11.

The seawater inlet port 83A is a hole that is opened to a branch pipe 83*a* of the seawater guide pipe 83 inside the flood control watertight compartments 31*a*, 32*a*, 31*b*, and 32*b*. The seawater guide pipe 83 allows the void space 81, and each of the flood control watertight compartments 31*a*, 32*a*, 31*b*, and 32*b* to communicate with each other. Moreover, the seawater guide pipe 83 is provided with a switching valve 84 that closes the seawater inlet port 83A of the branch pipe 83*a* inside the flood control watertight compartments 31*a*, 32*a*, 31*b*, and 32*b*, and the valve 84 is usually in a closed state. For example, the control unit 2 is mounted on the hull 10, and the control unit 2 is able to open and close the switching valve 84 by remote control.

When the side wall 20*a* of the port side located in the vicinity of the bulkhead 23 is damaged from the outside of the hull 10, the flood control watertight compartments 31*a* and 32*a* are flooded, but it is possible to suppress flooding to the room 42 (main engine room) and the room 41 (generator room). Furthermore, by opening the switching valve 84 by remote control, for example, the control unit 2 is able to allow the water flooded to the flood control watertight compartments 31*a* and 32*a* (31*b* and 32*b*) to enter the adjacent void spaces 81, thereby lowering the center of gravity of the hull 10. Moreover, by opening the switching valve 84, for example, water flooded to the flood control watertight compartments 31*a* and 32*a* is flooded to the undamaged flood control watertight compartments 31*b* and 32*b* on the opposite side of the vessel, and thus, the vessel 1 is able to suppress the inclination of the hull 10 due to the influence of flooding.

The switching valve 84 may be a check valve. In addition, a seawater inlet port 83B at the upper end is positioned above the upper surface of the freeboard deck 13 to pass through one of the flood control watertight compartments 31*a*, 32*a*, 31*b*, and 32*b*, and the seawater guide pipe 83 allows the space above the freeboard deck 13 to communicate with the void space 81. Thus, the seawater guide pipe 83 is able to cause the water, which damages the side wall 20*a* of the port side (side wall 20*b* of the starboard side) and is flooded to the upper surface of the freeboard deck 13, to flow into the void space 81, and it is possible to suppress the inclination of the hull 10 due to the influence of flooding. Thus, the seawater guide pipe 83 causes the flooded water on the upper surface of the freeboard deck 13 to flow into the void space 81. For this reason, the hull 10 may lower the center of gravity and suppress the inclination of the hull 10 due to the influence of flooding.

Second Embodiment

Figure 10:
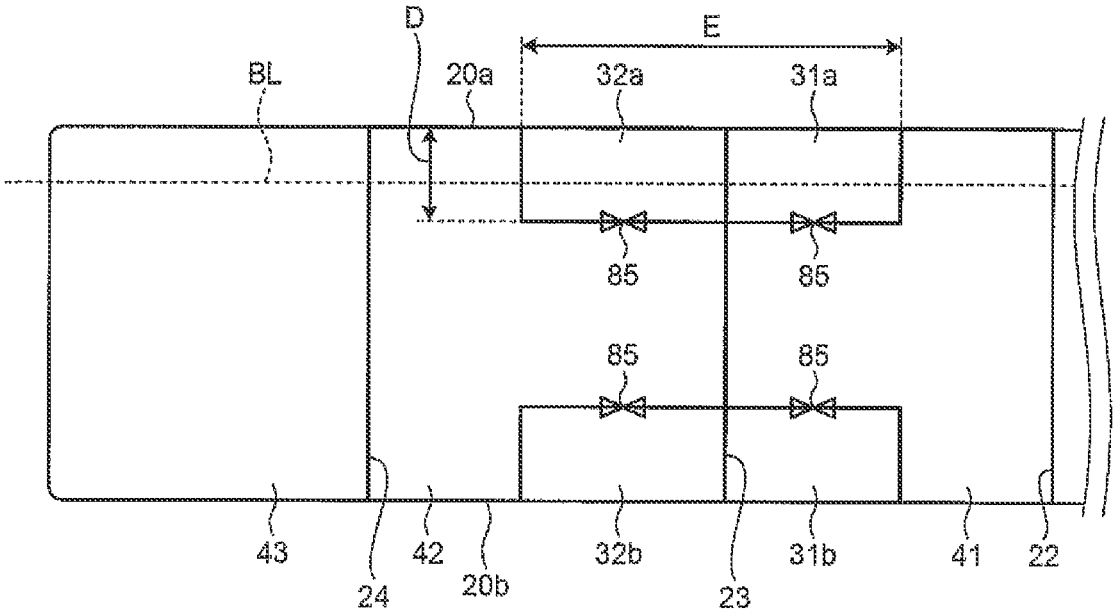
FIG. 10 is a partial plan view illustrating a flood control watertight compartment according to a second embodiment.

FIG. 10 is a partial plan view illustrating a flood control watertight compartment according to a second embodiment. In addition, the members having the same functions as the above-described embodiment are denoted by the same reference numerals, and the detailed description thereof will not be provided.

The flood control watertight compartments 31*a* and 32*a* (31*b* and 32*b*) according to the second embodiment has the room 42 (main engine room), the room 41 (generator room), and a watertight sliding door 85 that connects each of the flood control watertight compartments 31*a* and 32*a* (31*h* and 32*b*). The watertight sliding door 85 may be a valve that is able to remotely control the opening and closing by a watertight hatch or the above-described control unit 2.

The flood control watertight compartments 31*a* and 32*a* (31*b* and 32*b*) according to the second embodiment allow entry and exit to and from the interior of the flood control watertight compartments 31*a* and 32*a* (31*b* and 32*b*), by opening and closing the watertight sliding door 85. For this reason, the flood control watertight compartments 31*a* and 32*a* (31*b* and 32*b*) can be utilized as a warehouse, a device room configured to store a roll suppression (fin and stabilizer) device, an air conditioner, and a waste processing device, and a workshop configured to store a machine tool.

Figure 11:
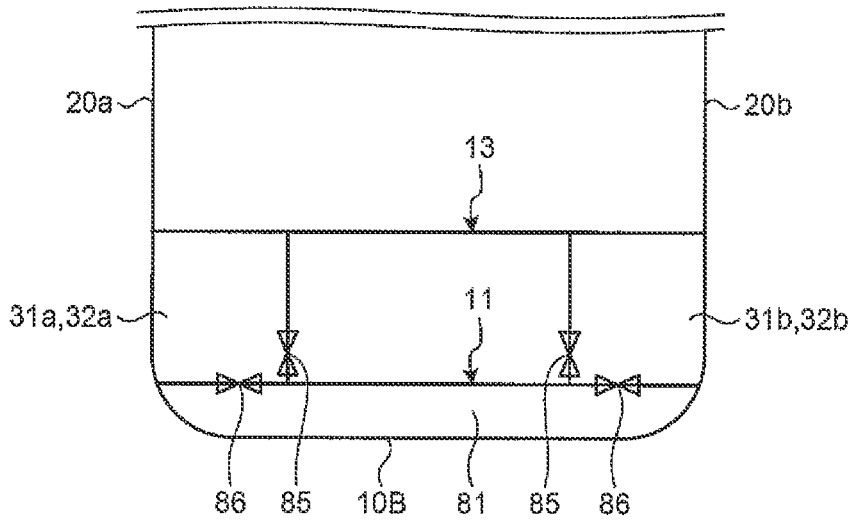
FIG. 11 is a cross-sectional view of the flood control watertight compartment illustrated in FIG. 10.

FIG. 11 is a cross-sectional view of the flood control watertight compartment illustrated in FIG. 10. As illustrated in FIG. 11, the flood control watertight compartments 31*a* and 32*a* (31*b* and 32*b*) are provided with a watertight sliding door 86 on the double bottom upper deck 11 as a double bottom plate. The watertight sliding door 86 may be a valve that is able to remotely control the opening and closing by a watertight hatch or the above-described control unit 2. When the wall 20*a* of the port side located in the vicinity of the bulkhead 23 is damaged from the outside of the hull 10, the flood control watertight compartments 31*a* and 32*a* are flooded, but flooding to the room 42 (main engine room) and the room 41 (generator room) is suppressed. Further, by opening the watertight sliding door 86, the water flooded to the flood control watertight compartments 31*a* and 32*a* (31*b* and 32*b*) is allowed to enter the lower void space 81, thereby lowering the center of gravity and promoting the improved stability of the hull 10. Furthermore, by opening the watertight sliding door 86, the undamaged flood control watertight compartment on the opposite side of the vessel is flooded, and the vessel 1 is able to suppress the inclination of the hull 10 due to the influence of flooding. Thus, the vessel 1 is provided with the hull 10 that includes the left and right side walls 20*a* and 20*b*, the bottom 10B, and the plurality of decks including the freeboard deck 13; the plurality of rooms 41 and 42 divided back and forth in the longitudinal direction of the hull 10 by the bulkhead 23 inside the hull 10; and the flood control watertight compartments 31*a*, 31*b*, 32*a*, and 32*b* that are disposed inside the plurality of rooms 41 and 42, divide the space from the double bottom upper deck 11 below the freeboard deck 13 to the freeboard deck 13, and are in contact with the side wall 20*a* or the side wall 20*b* and the bulkhead 23.

Figure 12:
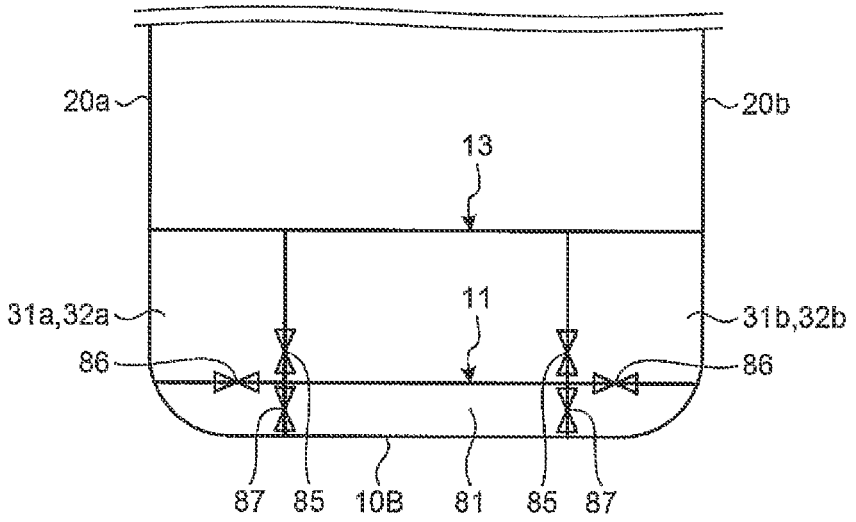
FIG. 12 is a cross-sectional view illustrating a first modified example of the flood control watertight compartment illustrated in FIG. 10.

FIG. 12 is a cross-sectional view illustrating a first modified example of the flood control watertight compartment illustrated in FIG. 10. As illustrated in FIG. 12, the flood control watertight compartments 31*a* and 32*a* (31*b* and 32*b*) are further provided with a watertight sliding door 87 in the bulkhead divided from the adjacent void space. By opening the watertight sliding door 86 and the watertight sliding door 87, the water flooded to the flood control watertight compartments 31*a* and 32*a* (31*b* and 32*b*) is allowed to enter the lower void space 81, thereby lowering the center of gravity and promoting the improved stability of the hull 10. In addition, by opening the watertight sliding door 87, the undamaged flood control watertight compartment of the opposite side of the vessel is flooded, and the vessel 1 is able to suppress the inclination of the hull 10 due to the influence of flooding.

Third Embodiment

Figures 1, 13:
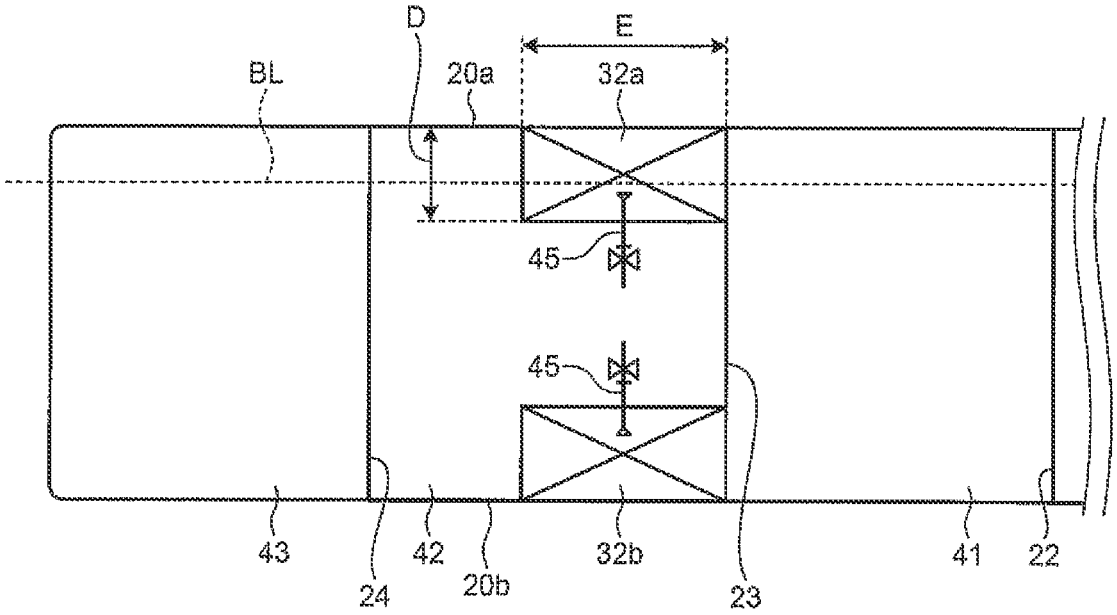
Figures 2, 13:
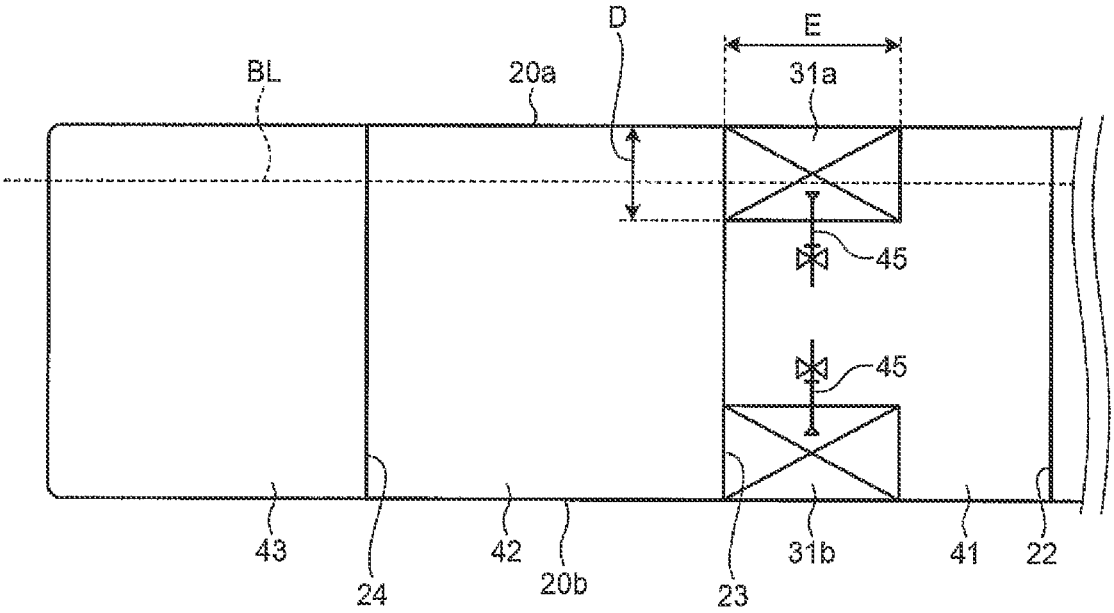

FIG. 13-1 is a partial plan view illustrating a flood control watertight compartment according to a third embodiment. In addition, the members having the same functions as the above-described embodiments are denoted by the same reference numerals, and the detailed description thereof will not be provided. The flood control watertight compartments 32*a* and 32*b* are disposed inside the room 42 (main engine room).

The hull 10 illustrated in FIG. 13-1 is provided with the left flood control watertight compartment 32*a* that is in contact with the side wall 20*a* of the port side and the bulkhead 23, and the right flood control watertight compartment 32*b* that is in contact with the side wall 20*b* of the starboard side and the bulkhead 23. The flood control watertight compartments 32*a* and 32*b* have a smaller volume compared to the room 42 (main engine room). Moreover, in the flood control watertight compartments 32*a* and 32*b*, the dimension D toward the inside of the hull 10 from the left and right side walls 20*a* and 20*b* is greater than the virtual line BL in which one-tenth of the width B of the hull 10 on the load water line WL is drawn along the inside of the left side wall 20*a* (right side wall 20*b*). That is, the dimension D is greater than one-tenth of the width B of the hull 10. In addition, the length (dimension) E of the flood control watertight compartment 32*a* (32*b*) in the longitudinal direction of the hull is set to be greater than the larger length obtained by comparing 3/100 of the larger length with 3 m when comparing the total length of the deck that limits the flooding range in the height direction, or the length between the front end and the rear end of the projected length of the hull 10 below the load water line WL. In this embodiment, the deck that limits the flooding range in the height direction means, in the decks that exceed the height obtained by adding 12.5 m to the draft of the load water line WL, any lower one between the lowest deck (the deck of the top layer when there is no deck that exceeds the height) and the deck as the upper limit of the range that can enter the reserve buoyancy. Thus, the dimension of the flood control watertight compartments 32*a* and 32*b* can also be set to be greater than the magnitude of the assumed damage that is defined in each of SOLAS Chapter II-1 Part. B-1 Regulation 8.3.2 as an international law, and Article 44 of vessel compartment regulations as a Japanese domestic law. As a result, it is possible to secure the sufficient flood control performance by the flood control watertight compartment 32*a* (32*b*).

When the side wall 20*a* of the port side located in the vicinity of the bulkhead 23 is damaged from the outside of the hull 10, the flood control watertight compartment 32*a* is flooded, but it is possible to suppress flooding to the room 42 (main engine room). In addition, since the flood control watertight compartment 32*a* smaller than the room 42 (main engine room) is flooded, the amount of flood to the room 42 (main engine room) is reduced. In addition, when the flood control watertight compartment 32*a* (32*b*) is used as a liquid tank, such as a freshwater tank, a ballast tank, and a fuel tank, the valve 45 of each liquid tank is provided outside the flood control watertight compartment 32*a* (32*b*). The valve 45 is provided in the pipe that injects liquid to the flood control watertight compartment 32*a* (32*b*). Moreover, for example, even if the vicinity of the bulkhead 23 in the side wall 20*a* of the port side is damaged and the flood control watertight compartment 32*a* is damaged and flooded, the valve 45 is less likely to be damaged. Consequently, by closing the valve 45, it is possible to reduce the possibility that flooding expands to another compartment through the damaged pipe.

FIG. 13-2 is a partial plan view illustrating a modified example of the flood control watertight compartment according to the third embodiment. In the hull 10 according to the third embodiment illustrated in FIG. 13-1, an example having the flood control watertight compartment 32*a* (32*b*) disposed on the room 42 (main engine room) side of the bulkhead 23 has been described. As illustrated in FIG. 13-2, instead of the flood control watertight compartment 32*a* (32*b*), the flood control watertight compartments 31*a* (31*b*) disposed on the room 41 (the generator chamber) side of the bulkhead 23 may be provided.

Fourth Embodiment

Figure 14:
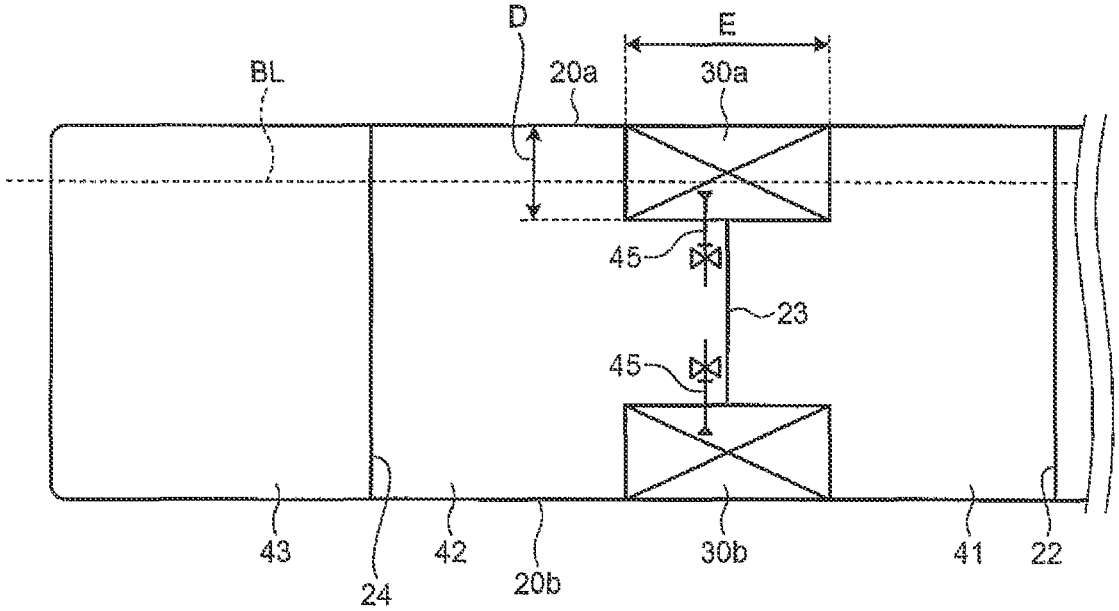
FIG. 14 is a partial plan view illustrating a flood control watertight compartment according to a fourth embodiment.

FIG. 14 is a partial plan view illustrating a flood control watertight compartment according to a fourth embodiment. In addition, the members having the same functions as the above-described embodiment are denoted by the same reference numerals, and the detailed description thereof will not be provided. The hull 10 illustrated in FIG. 14 is provided with a left flood control watertight compartment 30*a* that is in contact with the side wall 20*a* of the port side and is interposed between the side wall 20*a* of the port side and the bulkhead. 23, and a right flood control watertight compartment 30*b* that is in contact with the side wall 20*b* of the starboard side and is interposed between the side wall 20*b* of the starboard side and the bulkhead 23. The flood control watertight compartments 30*a* and 30*b* are located in the interior of both the room 42 (main engine room) and the room. 41 (generator room).

The flood control watertight compartments 30*a* and 30*b* have a smaller volume compared to one of the room 42 (main engine room) and the room. 41 (generator room). The dimensions extending to the inside of the hull 10 in the lateral direction from the left and right side walls 20*a* and 20*b* of the flood control watertight compartments 30*a* and 30*b* are greater than one-tenth of the width B of the hull 10 on the load water line WL. Furthermore, the length (dimension) of the flood control watertight compartment 30*a* (30*b*) toward the bow direction from the stern is set to be greater than the larger length obtained by comparing 3/100 of the larger length with 3 m when comparing the total length of the deck that limits the flooding range in the height direction, or the length between the front end and the rear end of the projected length of the hull 10 below the load water line WL. In this embodiment, the deck that limits the flooding range in the height direction means, in the decks that exceed the height obtained by adding 12.5 m to the draft of the load water line WL, any lower one of the lowest deck (the deck of the top layer when there is no deck that exceeds the height) and the deck as the upper limit of the range that can enter the reserve buoyancy. Thus, the dimension of the flood control watertight compartments 30*a* and 30*b* can also be set to be greater than the magnitude of the assumed damage that is defined in Article 44 of vessel compartment regulations. As a result, it is possible to secure the sufficient flood control performance by the flood control watertight compartment 30*a* (30*b*).

When the side wall 20*a* of the port side located in the vicinity of the bulkhead 23 is damaged from the outside of the hull 10, the flood control watertight compartment 30*a* is flooded, but it is possible to reduce the possibility that the room 42 (main engine room) or the room 41 (generator room) is flooded. In addition, since the flood control watertight compartment 32*a* smaller than one of the room 42 (main engine room) and the room. 41 (generator room) is flooded, the amount of flood to the room 42 (main engine room) or the room 41 (generator room) is reduced. In addition, when the flood control watertight compartment 30*a* (30*b*) is used as a liquid tank, such as a freshwater tank, a ballast tank, and a fuel tank, the valve 45 of each liquid tank may be provided outside the flood control watertight compartment 30*a* (30*b*). The valve 45 is provided in the pipe that injects liquid to the flood control watertight compartment 30*a* (30*b*). Moreover, for example, even if the vicinity of the bulkhead 23 in the side wall 20*a* of the port side is damaged and the flood control watertight compartment. 30*a* is damaged and flooded, the valve 45 is less likely to be damaged. Consequently, by closing the valve 45, it is possible to reduce the possibility that flooding expands to another compartment through the damaged pipe.

Fifth Embodiment

Figure 15:
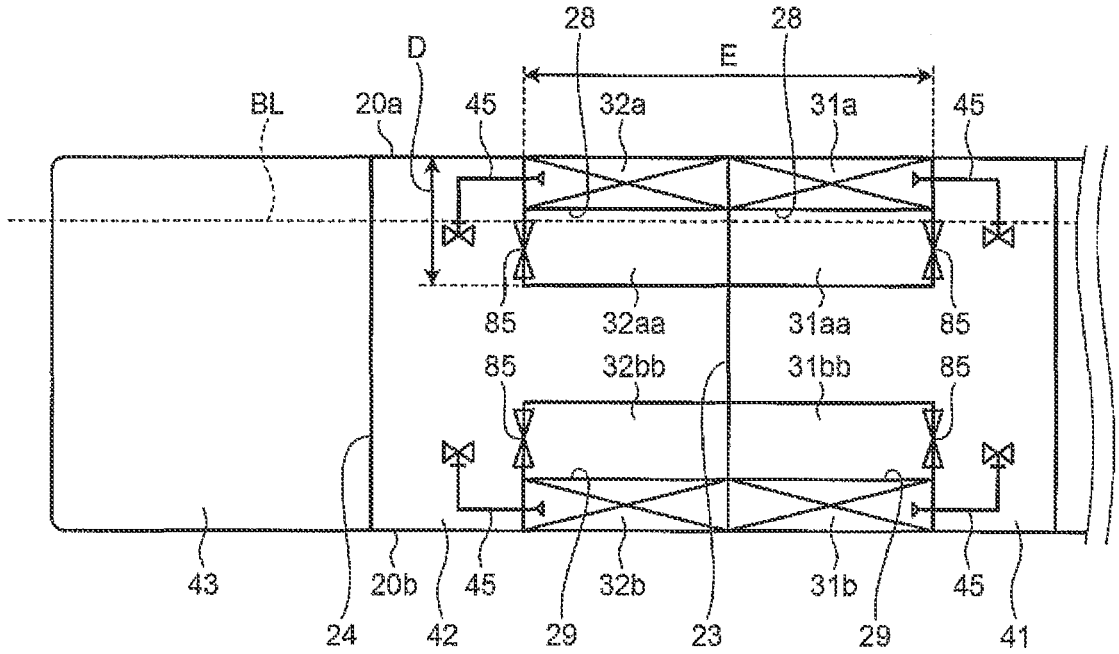
FIG. 15 is a partial plan view illustrating a flood control watertight compartment according to a fifth embodiment.

FIG. 15 is a partial plan view illustrating a flood control watertight compartment according to a fifth embodiment.

Figure 16:
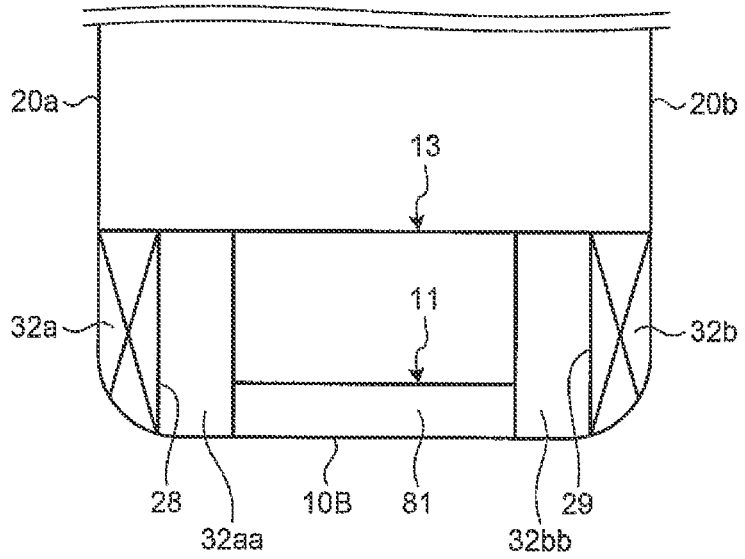
FIG. 16 is a cross-sectional view of the flood control watertight compartment illustrated in FIG. 15.

FIG. 16 is a cross-sectional view of the flood control watertight compartment illustrated in FIG. 15. In addition, the members having the same functions as the above-described embodiments are denoted by the same reference numerals, and the detailed description thereof will not be provided.

The hull 10 is provided with left flood control watertight compartments 31*a*, 31*aa*, 32*a*, and 32*aa* that are in contact with the side wall 20*a* of the port side and the bulkhead 23, and right flood control watertight compartments 31*b*, 31*bb*, 32*b*, and 32*bb* that are in contact with the side wall 20*b* of the starboard side and the bulkhead 23. A partition wall 28 divides the flood control watertight compartments 31*a* and 32*a*, and the flood control watertight compartments 31*aa* and 32*aa* in the lateral direction of the hull 10. In the lateral direction of the hull 10, a partition wall 29 divides the flood control watertight compartments 31*a* and 32*a* and the flood control watertight compartments 31*aa* and 32*aa* in the lateral direction of the hull 10. In addition, the flood control watertight compartment 32*a* (32*b*) is adjacent to the flood control watertight compartment 32*aa* (32*bb*) in the lateral direction of the hull 10, and the flood control watertight compartment 32*a* (32*b*) is in contact with the side wall 20*a* (20*b*) to be in contact with the room 42 (main engine room) side of the bulkhead 23. Similarly, the flood control watertight compartment 31*a* (31*b*) is adjacent to the flood control watertight compartment. 31*aa* (31*bb*) in the lateral direction of the hull 10, and the flood control watertight compartment 31*a* (31*b*) is in contact with the side wall 20*a* (20*b*) to be in contact with the room 41 (generator room) side of the bulkhead 23.

As illustrated in FIGS. 15 and 16, the flood control watertight compartments 31*a* and 31*aa* (31*b* and 31*bb*) have a smaller volume compared to the room 41 (generator room). In addition, the flood control watertight compartments 32*a* and 32*aa* (32*b* and 32*bb*) have a smaller volume compared to the room 42 (main engine room). As illustrated in FIG. 16, the flood control watertight compartments 31*a*, 31*aa*, 32*a*, and 32*aa* (31*b*, 31*bb*, 32*b*, and 32*bb*) are the watertight compartments that are divided from the bottom 10B of the hull 10 to the freeboard deck 13. Moreover, the dimension D, which extends to the inside of the hull 10 from the left side wall 20*a* (the right side wall 20*b*) in the lateral direction and is obtained by combining the length of each of the flood control watertight compartments 32*a* and 32*aa* (32*b* and 32*bb*), is greater than one-tenth of the width B of the hull 10 on the load water line WL. In addition, the length (dimension) E obtained by combining the length of each of the flood control watertight compartments 31*a* and 32*a* (31*b* and 32*b*) toward the bow direction from the stern is set to be greater than the larger length obtained by comparing 3/100 of the larger length with 3 m when comparing the total length of the deck that limits the flooding range in the height direction, or the length between the front end and the rear end of the projected length of the hull 10 below the load water line WL. In this embodiment, the deck that limits the flooding range in the height direction means, in the decks that exceed the height obtained by adding 12.5 m to the draft of the load water line WL, any lower one of the lowest deck (the deck of the top layer when there is no deck that exceeds the height) and the deck as the upper limit of the range that can enter the reserve buoyancy. Thus, the dimension of the flood control watertight compartments 31*a* and 31*aa* (31*b* and 31*bb*) can be set to be greater than the magnitude of the assumed damage that is defined in each of SOLAR Chapter II-1 Part. B-1 Regulation 8.3.2 as an international law, and Article 44 of vessel compartment regulations as a Japanese domestic law. As a result, it is possible to secure the sufficient flood control performance by the flood control watertight compartments 31*a* and 31*aa* (31*b* and 31*bb*).

By opening and closing the watertight sliding door 85, entry and exit to and from the interior of the flood control watertight compartments 31*aa* and 32*aa* (31*bb* and 32*bb*) are allowed. For this reason, the flood control watertight compartments 31*aa* and 32*aa* (31*bb* and 32*bb*) can be utilized as a warehouse, a device room configured to store a roll suppression (fin and stabilizer) device, an air conditioner, and a waste processing device, and a workshop configured to store a machine tool.

Figure 17:
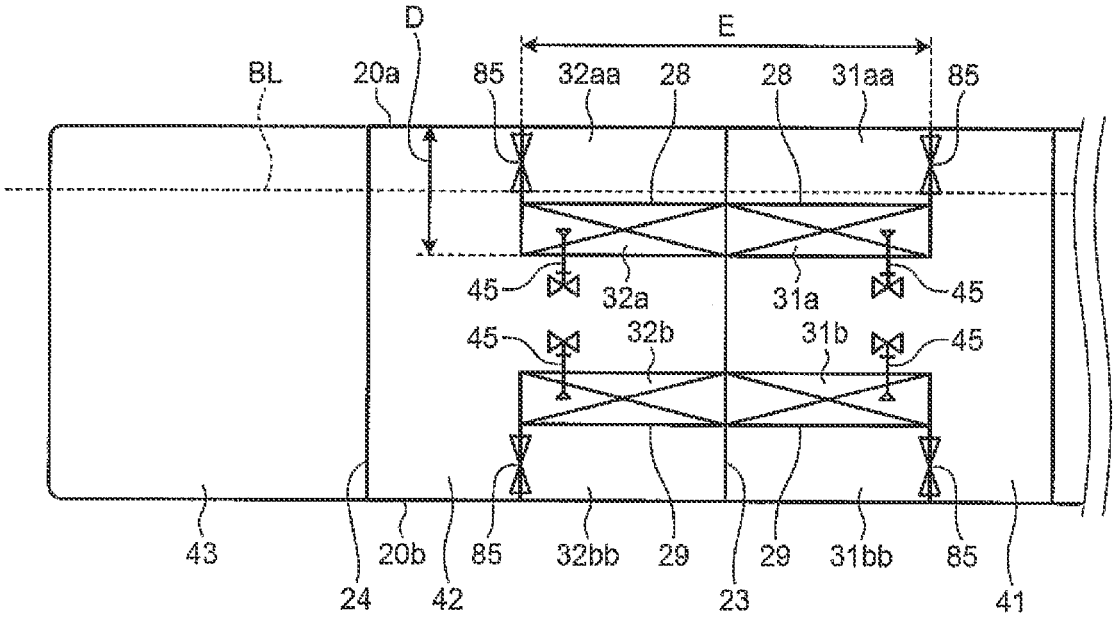
FIG. 17 is a partial plan view illustrating a flood control watertight compartment according to a modified example of the fifth embodiment.

FIG. 17 is a partial plan view illustrating a flood control watertight compartment according to a modified example of the fifth embodiment. As illustrated in FIG. 17, the hull 10 is provided with the left flood control watertight compartments 31*a*, 31*aa*, 32*a*, and 32*aa* that are in contact with the side wall 20*a* of the port side and the bulkhead 23, and the right flood control watertight compartments 31*b*, 31*bb*, 32*b*, and 32*bb* that are in contact with the side wall 20*b* of the starboard side and the bulkhead 23. Furthermore, the flood control watertight compartment 32*a* (32*b*) and the flood control watertight compartment 32*aa* (32*bb*) are provided side by side and are in contact with the room 42 (main engine room) side of the bulkhead 23, and the flood control watertight compartment 32*aa* (32*bb*) is in contact with the side wall 20*a* (20*b*). Similarly, the flood control watertight compartment 31*a* (31*b*) and the flood control watertight compartment 31*aa* (31*bb*) are provided side by side and are in contact with the room 41 (generator room) side of the bulkhead 23, and the flood control watertight compartment 31*aa* (31*bb*) is in contact with the side wall 20*a* (20*b*).

REFERENCE SIGNS LIST

1 VESSEL
2 CONTROL UNIT
10 HULL
10B BOTTOM
11 DOUBLE BOTTOM UPPER DECK
13 FREEBOARD DECK
12, 14, 15, 16, 17 DECK
20*a* SIDE WALL OF PORT SIDE (SIDE WALL)
20*b* SIDE WALL OF STARBOARD SIDE (SIDE WALL)
21*a*, 21*b* LONGITUDINAL BULKHEAD
22, 23, 24, 25 BULKHEAD
30*a*, 30*b*, 31*a*, 31*b*, 31*aa*, 31*bb*, 32*a*, 32*b*, 32*aa*, 32*bb*, 33*a*, 33*b* FLOOD CONTROL WATERTIGHT COMPARTMENT
41 ROOM (GENERATOR ROOM)
42 ROOM (MAIN ENGINE ROOM)
43 ROOM (SHAFT ROOM)
45 VALVE
61 BOW BROADSIDE RAMP WAY
62 STERN RAMP WAY
63, 64, 65 INBOARD RAMP
81 VOID SPACE
83 SEAWATER GUIDE PIPE
84 SWITCHING VALVE
85, 86, 87 WATERTIGHT SLIDING DOOR
90 DUCT
91, 92 PIPE
WL LOAD WATER LINE

The invention claimed is:

1. A vessel comprising:

a hull that includes side walls of a port side and a starboard side, a bottom, and a plurality of decks including a freeboard deck;

a bulkhead that is provided inside the hull to divide interior of the hull into a plurality of rooms in a longitudinal direction of the hull; and a flood control watertight compartment that is disposed inside at least one of the plurality of rooms, divides a space from a deck below the freeboard deck or the bottom to the freeboard deck, and is in contact with the side walls and the bulkhead, wherein the flood control watertight compartment is raised to be higher than the freeboard deck.

2. A vessel comprising:

a hull that includes side walls of a port side and a starboard side, a bottom, and a plurality of decks including a freeboard deck;

a bulkhead that is provided inside the hull to divide interior of the hull into a plurality of rooms in a longitudinal direction of the hull; and a flood control watertight compartment that is disposed inside at least one of the plurality of rooms, divides a space from a deck below the freeboard deck or the bottom to the freeboard deck, and is in contact with the side walls and the bulkhead, wherein the hull is provided with a longitudinal bulkhead along the side walls of the port side and the starboard side, on the inner side of each of the side walls of the port side and the starboard side on a bow side, and the flood control watertight compartment is provided on the each side walls of the port side and the starboard side that have no longitudinal bulkhead on the inner side of the hull.

3. A vessel comprising:

a hull that includes side walls of a port side and a starboard side, a bottom, and a plurality of decks including a freeboard deck;

a bulkhead that is provided inside the hull to divide interior of the hull into a plurality of rooms in a longitudinal direction of the hull; and a flood control watertight compartment that is disposed inside at least one of the plurality of rooms, divides a space from a deck below the freeboard deck or the bottom to the freeboard deck, and is in contact with the side walls and the bulkhead, wherein a duct is disposed above the flood control watertight compartment.

4. The vessel according to claim 1, wherein the flood control watertight compartment has a left flood control watertight compartment that is in contact with the side wall of the port side and the bulkhead, and a right flood control watertight compartment that is in contact with the side wall of the starboard side and the bulkhead.

5. The vessel according to claim 1, wherein an inside of at least one of the plurality of rooms is at least an inside of at least one of a generator room, a main engine room and a shaft room.

6. The vessel according to claim 1, wherein the flood control watertight compartment is each provided between the bulkhead and the side wall of the port side, and between the bulkhead and the side wall of the starboard side.

7. The vessel according to claim 1, wherein the flood control watertight compartment is each provided on each room side that is disposed back and forth in the longitudinal direction of the hull with the bulkhead interposed therebetween.

8. The vessel according to claim 1, wherein the flood control watertight compartment is each disposed inside both rooms which are disposed front and back of the bulkhead in a longitudinal direction of the hull.

9. The vessel according to claim 1, wherein the flood control watertight compartment has a smaller volume compared to the plurality of rooms, and a dimension in a lateral direction of the hull, which extends to the inside of the hull from the side wall of the port side or the side wall of the starboard side, is greater than one-tenth of a width of the hull at a load water line.

10. The vessel according to claim 2, wherein the flood control watertight compartment is raised higher than the freeboard deck.

11. The vessel according to claim 1, wherein the flood control watertight compartment has a smaller volume compared to the plurality of rooms, and a dimension of the flood control watertight compartment in the longitudinal direction of the hull is set to be greater than a larger length obtained by comparing 3/100 of the longer length with 3 m when comparing a total length of the deck that limits a flooding range in a height direction, or a length between a front end and a rear end of a projected length of the hull below a load water line.

12. The vessel according to claim 1, wherein a valve is provided in a pipe that injects liquid to the flood control watertight compartment, and the valve is disposed outside the flood control watertight compartment.

13. The vessel according to claim 1, wherein the flood control watertight compartment causes to drain water flowing into the flood control watertight compartment to a double bottom partitioned by a lower deck than the freeboard deck.

14. The vessel according to claim 1, further comprising at least one of a watertight sliding door, a watertight hatch and a valve connecting the flood control watertight compartment and an inside of at least one of the plurality of rooms.

15. The vessel according to claim 2, wherein the flood control watertight compartment has a left flood control watertight compartment that is in contact with the side wall of the port side and the bulkhead, and a right flood control watertight compartment that is in contact with the side wall of the starboard side and the bulkhead.

16. The vessel according to claim 2, wherein an inside of at least one of the plurality of rooms is at least an inside of at least one of a generator room, a main engine room and a shaft room.

17. The vessel according to claim 2, wherein the flood control watertight compartment is each provided between the bulkhead and the side wall of the port side, and between the bulkhead and the side wall of the starboard side.

18. The vessel according to claim 2, wherein the flood control watertight compartment is each provided on each room side that is disposed back and forth in the longitudinal direction of the hull with the bulkhead interposed therebetween.

19. The vessel according to claim 2, wherein the flood control watertight compartment is each disposed inside both rooms which are disposed front and back of the bulkhead in a longitudinal direction of the hull.

20. The vessel according to claim 2, wherein the flood control watertight compartment has a smaller volume compared to the plurality of rooms, and a dimension in a lateral direction of the hull, which extends to the inside of the hull from the side wall of the port side or the side wall of the starboard side, is greater than one-tenth of a width of the hull at a load water line.

* * * * *